United States Patent [19]

Moody

[11] 4,407,091

[45] Oct. 4, 1983

[54] WRIST ATTACHED RATTLE AND EDUCATIONAL DEVICE FOR INFANTS

[76] Inventor: Gary W. Moody, 1010 Parkside Blvd., Toledo, Ohio 43607

[21] Appl. No.: 287,319

[22] Filed: Jul. 27, 1981

[51] Int. Cl.[3] ..... A63H 5/00

[52] U.S. Cl. ..... 46/193; 46/175 R

[58] Field of Search ..... 46/175 R, 193, 1 R, 46/47, 191; 434/304, 198, 159; 84/402, 403

[56] References Cited

U.S. PATENT DOCUMENTS

| | | | |
|---|---|---|---|
| D. 159,667 | 8/1950 | Ross | 46/193 X |
| 385,002 | 6/1888 | Pagan | 46/191 |
| 2,289,314 | 7/1942 | Davis | 46/193 |
| 2,570,740 | 10/1951 | Wise | 46/175 R X |
| 2,728,150 | 12/1955 | O'Neil | 434/304 |

OTHER PUBLICATIONS

"Musical Sleigh Bells", Wexler Catalog ©1965, p. 504, 823 S. Wabash, Chicago, Ill. 60605.

*Primary Examiner*—Mickey Yu

*Attorney, Agent, or Firm*—Wilson, Fraser, Barker & Clemens

[57] ABSTRACT

The embodiment shown and described is a rattle for infants for attachment to the wrist, and in general resembles a wrist watch in appearance. It includes a casing of sheet material containing a quantity of small pebble-like translucent pieces of multi-faceted hard plastic, glass, or the like capable of rattling around creating the noise attributed to an infant's rattle. Since attachment by straps to the wrist not only militates against loss but also the infant's arm movements automatically effects the desired noise making. Another feature is coloring of the translucent pieces or prisms and forming them with facets for catching, refracting or reflecting the light's rays for visual interest. Around the periphery is an alphabet containing flange and the lens has a manual pointer for use with the alphabet affording an educational feature.

4 Claims, 2 Drawing Figures

WRIST ATTACHED RATTLE AND EDUCATIONAL DEVICE FOR INFANTS

BACKGROUND AND SUMMARY OF THE INVENTION

Infants' rattles usually require constant attention because due to inattention or perhaps lack of sustaining strength, the rattle is abandoned and then mislaid or lost. It is a desideratum to arranged for the rattle not only to be ever present for the infant, but also that it create the desired noise almost automatically, or at least, without conscious endeavor on the part of the child. It would additionally be noteworthy for the rattles to be free of the lost and found department.

In accordance with this invention the above difficulties and objections are overcome in an exceedingly simple manner. The rattle having all the attributes of the conventional infant's rattle is strapped to the infant's wrist. Thus, it can't be lost or misplaced so long as the infant is visible or within earshot. Additionally, inasmuch as the infant's arms are almost constantly in motion, the rattle will automatically emit the clattering noise. This invention also forms the pebble-like pieces which create the rattling sound from hard plastic material which is not only translucent and colored, but also faceted to create a visual interest to the child by forming refracted or reflected light rays.

An educational feature of the rattle resides in a circular row of letters of the alphabet within an associated manual pointer, thus providing a useful fascination.

BRIEF DESCRIPTION OF THE DRAWINGS

The above as well as other objects and advantages of the invention will be, apparant to one skilled in the art from reading the following detailed description of a preferred embodiment of the invention when considered in the light of the accompanying drawings, in which.

DESCRIPTION OF PREFERRED EMBODIMENT

Figure 1:
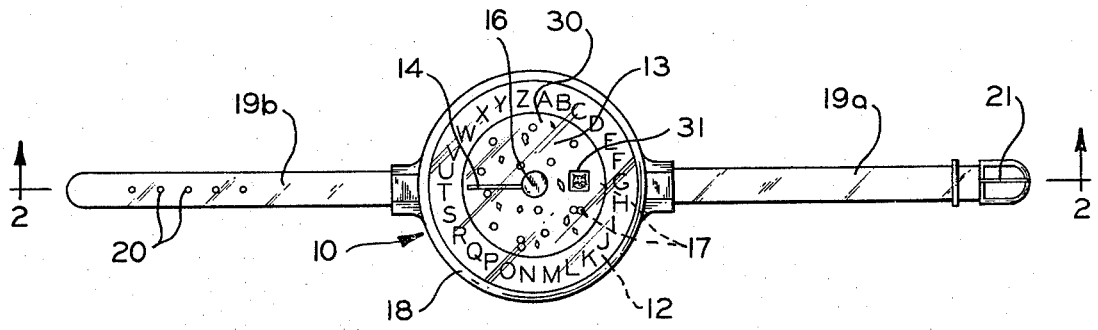
FIG. 1 is a top plan view of a wrist attached rattle for infants.
Figure 2:
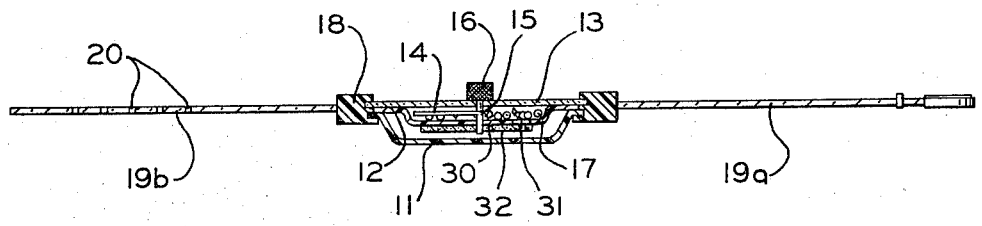
FIG. 2 is an enlarged sectional elevation taken along line 2—2 of FIG. 1.

The illustrated embodiment of the invention comprises a housing 10 simulating in size and shape a wrist watch and having a cup-like open mouth container 11 of plastic, metal, or other light weight sheet material. The container 11 has a laterally extending flat circular flange 12 which surrounds it and displays on its marginal upper face the alphabet. Covering the mouth of the container 11 and the flange 12 is a translucent lens 13 preferably formed of plastic material. On the underside of the lens 13 for selective designation of a letter of the alphabet is a pointer 14 which is fixed at its inner end to a shaft 15 extending through the center of the lens. On the outside of the lens and fixed to the shaft 15 is a knurled knob 16 which enables turning of the pointer 14 from one letter to another.

The rattle toy may also include an opaque face 30 between the lens 13 and the base of the container 11, through which the shaft 15 extends. The face 30 includes an aperture 31. A disc 32 is suitably secured to the lower portion of the shaft 15 immediately below the face 30, for co-rotation with the pointer 14. As an educational feature, indicia are arranged on the disc to appear through the aperture as the pointer 14 is rotated to corresponding indicia on the flange 12.

Within the container 11 between the lens 13 and the face 30 are several pebble-like hard pieces 17 which are free to be impelled around according to the movement of the container in one direction or another. Since the container is to be mounted on an infant's wrist, as will hereinafter appear, movement of the wrist will cause the pieces to impinge or strike against the sides of the container and the lens and emit noises or sounds like a clatter or rattle, for affording amusement. The pieces 17 may be of hard plastic or of metal but preferably of a translucent multifaceted plastic of different colors and of regular or irregular shapes, thereby adding to the interest and fascination of the device to an infant due to the light refraction, reflection, and the changing colors.

The container 11 and lens 13 are secured together by bezel-like rings 18 which connects these parts as a unit. Suitably coupled to the opposite sides of the ring 18 are flexible wrist band parts 19*a* and 19*b*. The part 19*b* having a series of holes 20 and the free end of the part 19*a* having the usual pivoted latch 21 for entering a selected hole 20 and securing the parts together on a person's wrist.

It will be manifest that I have produced a child's rattle of unusual merit and charm. Not only creating rattling sounds which are not too loud and in addition creating a multi-colored effect from the light directed against them. The complaint of losing the rattle is obviated because of its attachment to the child's wrist. A further feature resides in the alphabet and pointer which, as the child grows older, affords educational value.

Various changes may be effected in structure, design, and choice of materials without departing from the spirit of the invention.

What I claim is:

1. An infant's rattle comprising a relatively small closed container providing substantial wall area, a quantity of pebble-like materials within said container to hit against the walls thereof upon a shaking movement, strap means for attaching the container to an infant's wrist whereby loss or misplacement of the rattle is avoided and the normal movement of the infant's arm automatically produces the desired sound, a transparent cover for the top of said container, a lateral flat flange on said container adjacent to and within said transparent cover, a circular row of indicia of the alphabet displayed on said flange, and a manually actuated pointer for said row rotatably connected to said transparent cover for affording and educational feature to the rattle.

2. An infant's rattle as claimed in claim 1, including a transparent cover for the top of said container, and pebble-like materials including hard plastic materials of different colors thereby visually to tittilate the infant's fancy.

3. An infant's rattle as claimed in claim 2 wherein the colored materials are faceted or prismatic thereby to refract or reflect the light rays impinging thereon.

4. An infant's rattle as claimed in claim 1 including an opaque face within said container spaced from said transparent cover, said face including an aperture formed therethrough, a shaft rotatably mounted on said transparent cover and said face, said pointer being secured to said shaft between said face and transparent cover, a disc secured to said shaft for co-rotation with said pointer, and indicia corresponding to letters of the alphabet arranged on said disc to appear through the aperture when said pointer is aligned with corresponding letters.

* * * * *